US009642410B2

(12) United States Patent
Grice

(10) Patent No.: US 9,642,410 B2
(45) Date of Patent: May 9, 2017

(54) HELMET WITH EXTERNAL SHOCK WAVE DAMPENING PANELS

(71) Applicant: Darin Grice, Whitestown, IN (US)

(72) Inventor: Darin Grice, Whitestown, IN (US)

(73) Assignee: Turtle Shell Protective Systems LLC, Whitestown, IN (US)

( * ) Notice: Subject to any disclaimer, the term of this patent is extended or adjusted under 35 U.S.C. 154(b) by 822 days.

(21) Appl. No.: 13/760,207

(22) Filed: Feb. 6, 2013

(65) Prior Publication Data

US 2014/0215694 A1 Aug. 7, 2014

(51) Int. Cl.
*A42B 3/06* (2006.01)

(52) U.S. Cl.
CPC ..... *A42B 3/06* (2013.01)

(58) Field of Classification Search
CPC ..... A42B 3/06; A42B 3/128; A42B 3/065; A42B 3/125
USPC ..... 2/410–413
See application file for complete search history.

(56) References Cited

U.S. PATENT DOCUMENTS 2,759,186 A * 8/1956 Dye ..... A42B 3/121 2/413
3,039,109 A * 6/1962 Simpson ..... A42B 3/121 2/413
3,609,764 A * 10/1971 Morgan ..... A42B 3/122 2/414
3,872,511 A * 3/1975 Nichols ..... A42B 3/121 2/413
4,223,409 A * 9/1980 Lee ..... A42B 3/065 2/411
4,239,106 A * 12/1980 Aileo ..... A42C 2/007 2/414
4,290,149 A * 9/1981 Aileo ..... A42C 2/007 2/414
4,324,005 A * 4/1982 Willis ..... A42B 3/0486 2/413
4,564,959 A * 1/1986 Zahn ..... A42B 3/065 2/184.5
4,665,569 A 5/1987 Santini
4,766,614 A * 8/1988 Cantwell ..... A42B 3/281 2/171.3
5,204,998 A * 4/1993 Liu ..... A42B 3/121 2/411
5,561,866 A * 10/1996 Ross ..... A42B 3/124 2/410
5,950,244 A * 9/1999 Fournier ..... A42B 3/128 2/411
5,956,777 A * 9/1999 Popovich ..... A42B 3/065 2/412

(Continued)

FOREIGN PATENT DOCUMENTS

CA 2 669 890 12/2010

*Primary Examiner* — Richale Quinn
(74) *Attorney, Agent, or Firm* — Woodard, Emhardt, Moriarty, McNett & Henry LLP

(57) ABSTRACT

A helmet including a shell, a plurality of panel buttons pivotally attached at their proximal face to the outer surface of the shell, and the panel buttons are made of a flexible or elastic material with a protective outer coating to protect the panel buttons from abrasion. In one embodiment, the panel buttons are pivotally attached to the outer surface of the shell with a living hinge that allows the panel buttons to swivel in multiple planes that are generally perpendicular to the outer surface of the shell.

26 Claims, 5 Drawing Sheets

(56) References Cited

U.S. PATENT DOCUMENTS 6,260,212 B1 * 7/2001 Orotelli ..... A42B 3/06 2/410
6,314,586 B1 * 11/2001 Duguid ..... A42B 3/069 2/411
6,378,140 B1 * 4/2002 Abraham ..... A42B 3/064 2/411
6,389,607 B1 5/2002 Wood
6,434,755 B1 8/2002 Halstead et al.
6,493,881 B1 12/2002 Picotte
6,969,548 B1 * 11/2005 Goldfine ..... A41D 31/0061 206/523
6,986,168 B2 1/2006 Abelman et al.
7,103,923 B2 9/2006 Picotte
7,159,249 B2 1/2007 Dennis et al.
7,254,843 B2 8/2007 Talluri
7,316,036 B2 1/2008 Rudolf et al.
7,478,438 B2 1/2009 Lolis
7,673,351 B2 3/2010 Copeland et al.
7,765,622 B2 8/2010 Wiles
7,774,866 B2 * 8/2010 Ferrara ..... A42B 3/121 2/455
7,895,681 B2 * 3/2011 Ferrara ..... B29C 45/0053 2/455
7,950,073 B2 5/2011 Ferrara
8,001,622 B1 8/2011 Culley et al.
8,069,498 B2 12/2011 Maddux et al.
8,082,599 B2 12/2011 Sajic
8,166,574 B2 5/2012 Hassler
8,566,968 B2 * 10/2013 Marzec ..... A42B 3/12 2/411
8,726,424 B2 * 5/2014 Thomas ..... A42B 3/124 2/414
8,814,150 B2 * 8/2014 Ferrara ..... F16F 1/376 2/413
8,844,066 B1 * 9/2014 Whitcomb ..... A42B 3/121 2/413
8,955,169 B2 * 2/2015 Weber ..... A42B 3/125 2/410
9,113,672 B2 * 8/2015 Witcher ..... A42B 3/122
9,332,800 B2 * 5/2016 Brown ..... A42B 3/122
2007/0190293 A1 * 8/2007 Ferrara ..... B29C 45/0053 428/166
2008/0256686 A1 10/2008 Ferrara
2010/0000009 A1 1/2010 Morgan
2010/0186150 A1 * 7/2010 Ferrara ..... A42B 3/128 2/412
2011/0203024 A1 8/2011 Morgan
2011/0296594 A1 * 12/2011 Thomas ..... A42B 3/124 2/414
2012/0124718 A1 5/2012 Picotte
2013/0014313 A1 * 1/2013 Erb ..... A42B 3/122 2/410
2013/0174331 A1 * 7/2013 Witcher ..... A42B 3/121 2/413
2014/0068841 A1 * 3/2014 Brown ..... A42B 3/122 2/413
2014/0123371 A1 * 5/2014 Witcher ..... A42B 3/121 2/413

* cited by examiner

HELMET WITH EXTERNAL SHOCK WAVE DAMPENING PANELS

BACKGROUND OF THE INVENTION

This invention relates generally to protective headgear, and more particularly relates to protective headgear with external structures that dampen the shock wave from an impact before it reaches the protective shell and internal padding of a helmet.

Helmets have been used for centuries to protect the head from injury that would otherwise result from an impact. The typical helmet has a rigid outer shell and internal padding which spreads and cushions blows to the wearer's head. A drawback to those helmets is that they do little to dissipate the shock wave before it reaches the padding and internal support structures next to the wearer's head. Despite the presence of internal padding, the force may be nonetheless sufficient to cause a concussion, a contusion, or even a fractured skull. What is needed our structures mounted on a helmet's exterior that can dampen a shock wave before it reaches the protective shell. The invention described in this document provides an answer to that need.

BRIEF SUMMARY OF THE INVENTION

In general, this invention is a helmet with external and pivotally mounted buttons that dissipate a shockwave before it reaches the protective shell surrounding the wearer's head. The helmet has a shell. A plurality of panel buttons is pivotally mounted on the outer surface of the shell. The proximal side of the panel buttons is pivotally secured in a manner so that it can swivel swivel in multiple planes that are generally perpendicular to the outer surface of the shell. The panel buttons are also made of flexible or elastic material, and the panel buttons alternatively include a protective rigid coating to protect the panel buttons from abrasion. In its generally preferred embodiment the lateral edges of the panel buttons are aligned with directly adjacent panel buttons to give the helmet a smooth appearance. Also in its generally preferred embodiment the panel buttons are pivotally secured to the outer surface of the shell with a living hinge.

DETAILED DESCRIPTION OF ILLUSTRATIVE EMBODIMENTS

Figure 1:
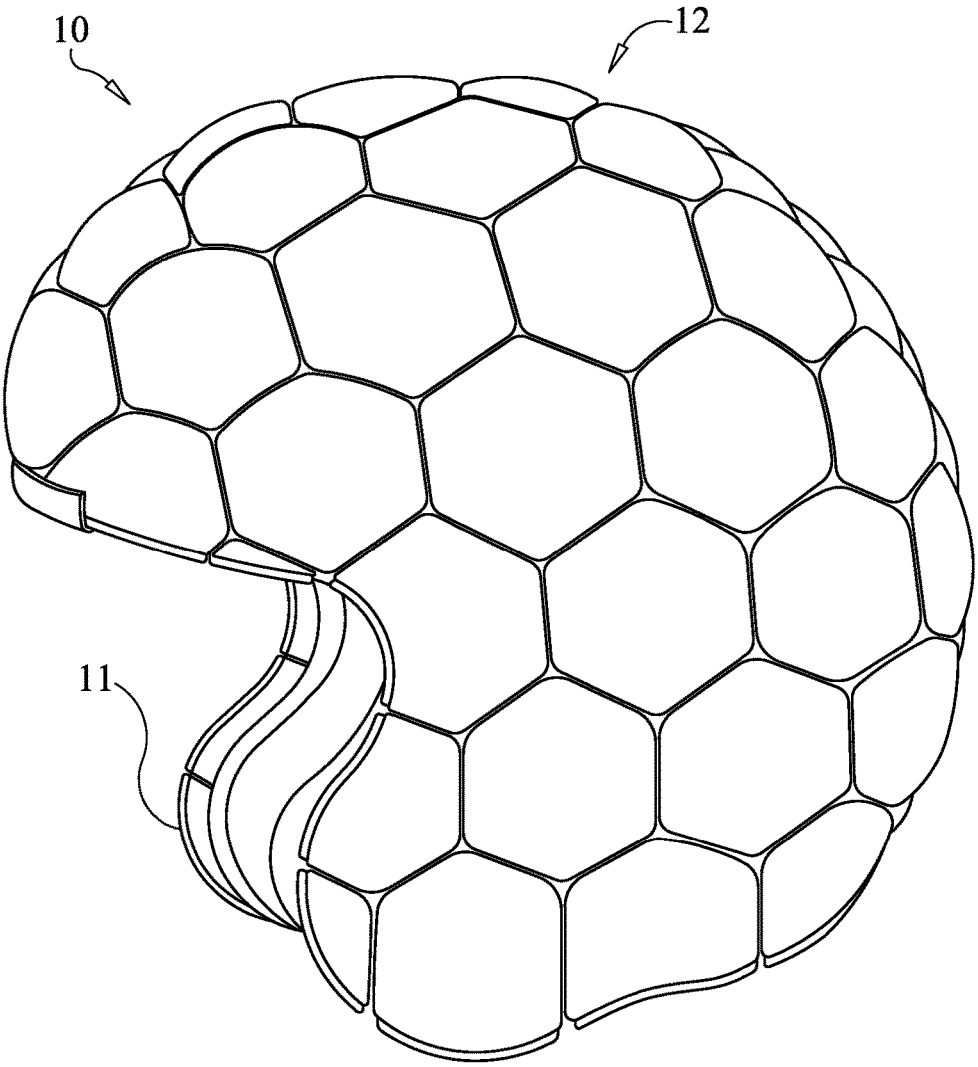
FIG. 1 is a perspective view of a helmet according to one embodiment of the invention.

For the purpose of promoting an understanding of the invention, reference will now be made to the embodiments of the invention illustrated in the drawings and specific language will be used to describe them. It should be understood that no limitation of the scope of the invention is intended by using specific language. Alterations and modifications to the helmet or the parts of the helmet illustrated in the drawings are also included in the invention if the claims at the end of this specification read upon a helmet that has those alterations and modifications.

FIG. 1 shows a helmet 10 according to one embodiment of the invention. Helmet 10 includes a shell 11 and a plurality of panel buttons 12 attached to the outer surface of shell 11. Directing your attention to FIG. 2, each panel button such as panel button 13 in FIG. 2 has a proximal side 17, a distal face 20, and a lateral edge 19. The panel buttons are preferably made of a flexible material such as a rubber or suitable plastic that has flexible or elastic properties. The panel buttons also preferably include a rigid covering 24 made of, for example, a polycarbonate resin fixedly secured over the top of the flexible material that otherwise comprises a majority of each panel button. Both the panel button and the optional rigid covering are typically fabricated by injection molding. But it is, however, contemplated that a polymeric coating could be sprayed on the distal face of each panel button after the panel button is molded to form the rigid covering in situ, rather than molding the rigid covering separately and later attaching it to the distal face of the panel button with, for example, glue or mechanical fasteners.

Figure 2:
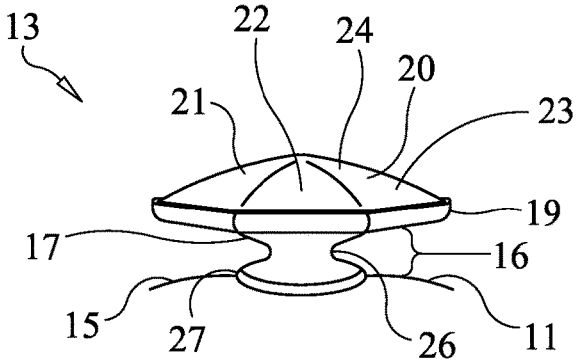
FIG. 2 is a perspective view of a panel button according to one embodiment of the invention.

The distal face 20 of the panel buttons used to practice this invention can have a variety of profiles. The distal face can be flat, concave, or convex, but is preferably convex in the form of a dome or cone. The distal face can also be smooth, but it is also contemplated that the distal face is composed of individual plane surfaces or facets. The panel button shown in FIG. 2 depicts a distal face 20 with a total of six facets. Facets 21, 22, and 23 are shown and the other three facets completing distal face 20 are not shown.

Figure 6:
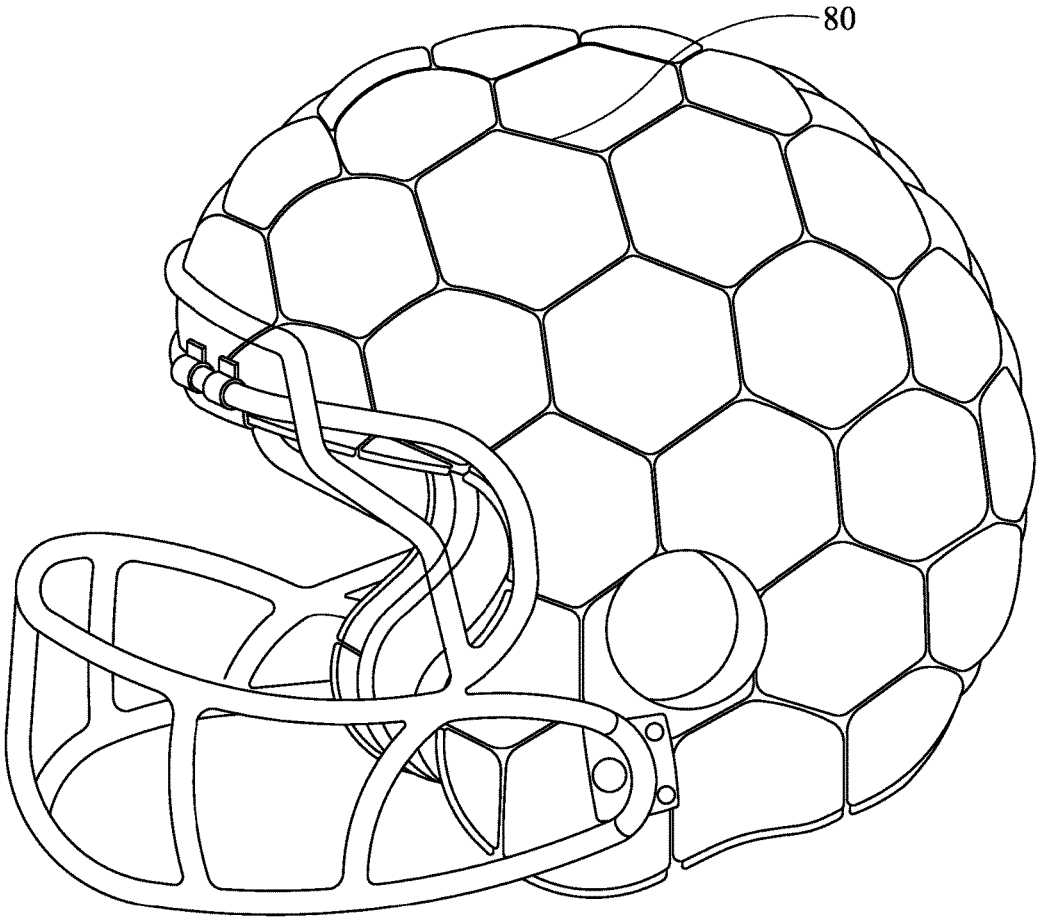
FIG. 6 is a perspective view of a football helmet and face mask according to one embodiment of the invention.

The distal face 20 of the panel buttons used to practice this invention can also have a variety shapes. For example, the panel buttons can have a regular shape such as the hexagonal shape as shown in FIGS. 1 and 6. The panel buttons, however, could also be circular, triangular, square, octagonal, or even be irregular polyhedrons as the invention is not limited by the particular shape of each panel button.

Panel buttons of different shapes or profiles may also be mounted on the same helmet. There is no need for all the panel buttons to have the same overall shape or profile in order to practice the invention.

The panel buttons used to practice this invention are pivotally secured to the shell 11. The embodiment of the panel button depicted in FIG. 2 is a panel button 13 attached to the outer surface 15 of shell 11 with a living hinge 16. The proximal side 17 of panel button 16 is generally convex. The proximal side 17, however, does not completely narrow at the apex of the convex shape in this particular embodiment of the invention. Rather, the proximal side 17 narrows to a generally cylindrical web 26 then expands to a generally round base 27, with base 27 being fixedly secured the outer surface 15 of shell 11. Base 27 is for example, fixedly secured to the outer surface 15 of shell with a screw 58 (FIG. 3) or similar mechanical fastener. Fashioned in this manner, the web 26 provides a flexure bearing locus around a central axis, or more simply a pivot, around which the panel button 13 can swivel in a multiple number of planes once it is attached to the outer surface 15 of shell 11.

Figure 3:
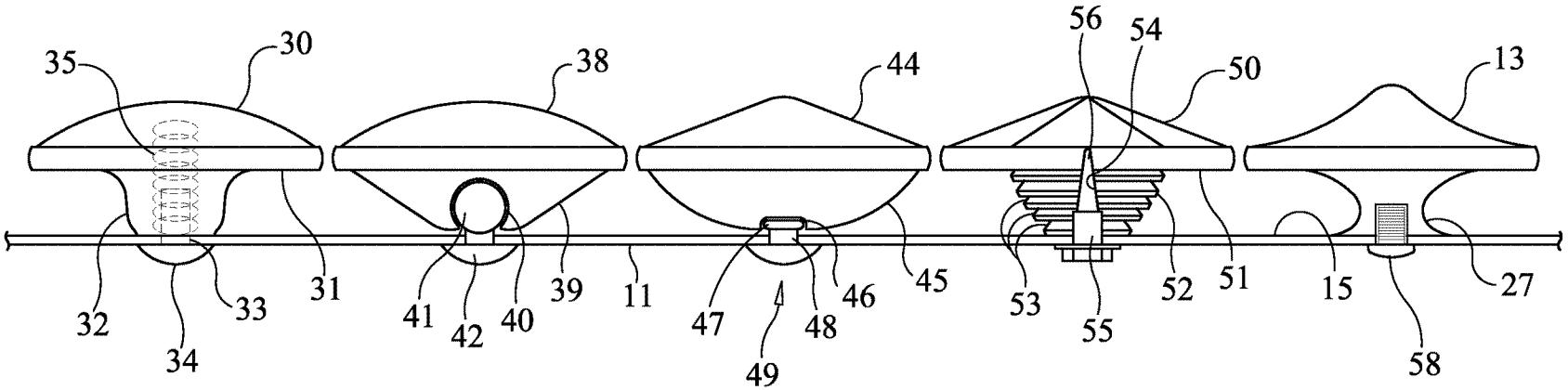
FIG. 3 is side view of panel buttons that may be used to practice alternative embodiments of the invention.

One can practice this invention by pivotally attaching the proximal side 17 of panel button 12 to the outer surface of shell 11 by means other than a living hinge. For example, four additional means by which a practitioner of this invention might pivotally secure a panel button is shown in FIG. 3. A first of these is the method by which panel button 30 is attached. The proximal side 31 of panel button 30 includes a downward-extending projection 32 with a bore 33 therein that is sized to accept rivet 34. Downward extending projection 32 is integrally formed with the same flexible material as the majority of the panel button and optionally also includes a reinforcing spring 35 around which panel button 30 is molded. Fashioned in this manner, the downward extending projection provides a flexure bearing locus, or pivot, around which panel button 30 can swivel in a multiple number of planes.

A second of these is the method by which panel button 38 is attached in FIG. 3. The proximal side 39 is generally convex shaped with a spherical socket 40 formed therein, preferably near the apex, that is sized to accept ball 41. Ball 41 is then secured to the outer surface of shell 11 by mechanical fastener 42, such a screw, rivet, or integral post. Fashioned in this manner, the ball-and-socket joint formed by spherical socket 40 and ball 41 provides a bearing locus, or pivot, around which panel button 38 can swivel in a multiple number of planes.

A third of these is the method by which panel button 44 is attached in FIG. 3. The proximal side 45 is generally convex shaped with a chamber 46 formed therein, preferably near the apex, that is sized to accept the female portion 47 of mechanical snap 49. The convex-shaped proximal side 45 of panel button 44 is formed with the same flexible material as the majority of the panel button. Female portion 47 of mechanical snap 49 is then attached by engaging it with the male portion 48 of mechanical snap 49. Fashioned in this manner, the chamber 46 and mechanical snap 49 provides a bearing local or pivot, around which panel button 44 can swivel in a multiple number of planes.

A fourth of these is the method by which panel button 50 is attached in FIG. 3. The proximal side 51 includes a downward extending projection 52 with a series of annular grooves 53 cut therein as well as a central bore 54. Central bore 54 is sized to accept a rivet or screw 55. The annular grooves increase the flexibility of downward extending projection 52. This embodiment may also optionally include a reinforcement member 56 to limit the ability of projection 52 to flex. Nevertheless and fashioned in this manner, the downward extending projection provides a flexure bearing locus, or pivot, around which panel button 50 can swivel in a multiple number of planes.

The method by which each of a plurality of panel buttons 12 (FIG. 1) is attached to the outer surface 15 of shell 11 does not have to be uniform. It is contemplated by this invention that the method of attachment could be the same or different depending, for example, on the desire to have some panel buttons to have a greater resistance to pivoting than other panel buttons located on the same helmet.

Figure 4:
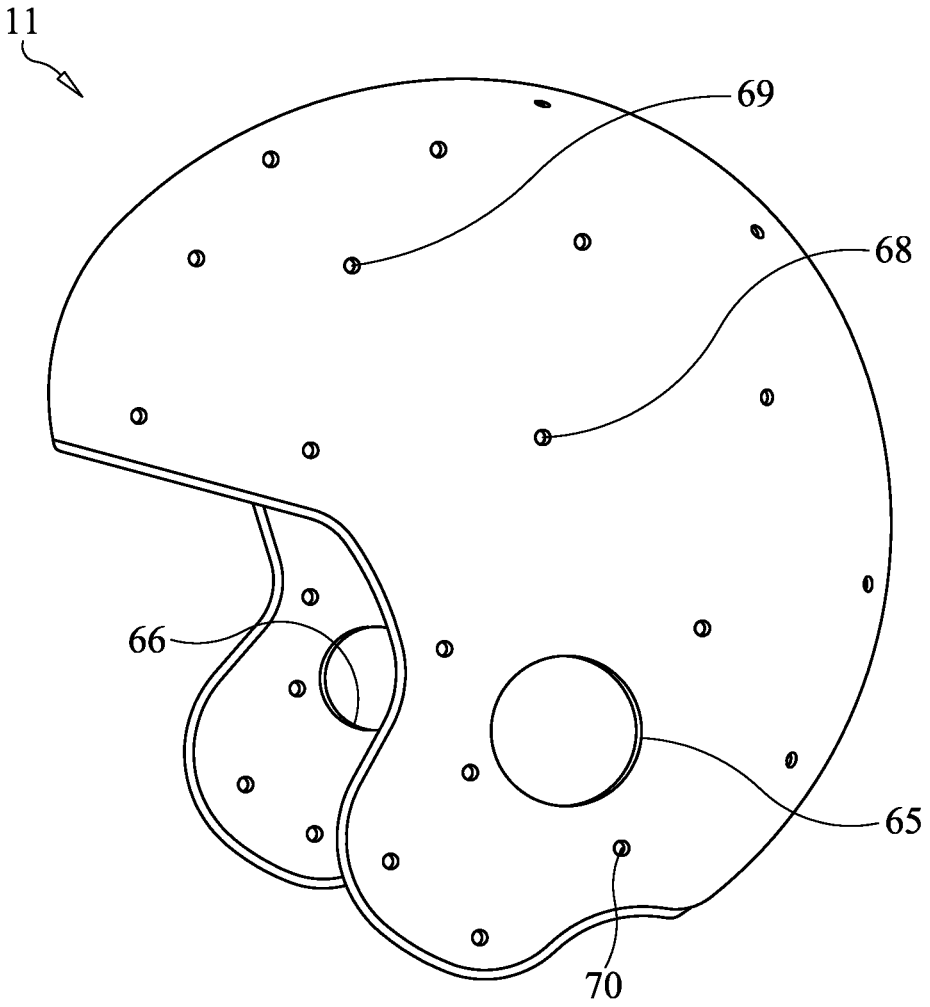
FIGS. 4 and 5 are perspective views of shells that may be used to practice alternative embodiments of the invention.

FIG. 4 shows an example of the shell 11 that may be used to practice this invention. The shell may optionally contain openings 65 and 66 to allow access to wearer's ears. The plurality of smaller holes; for example holes 68, 69, and 70; are placed in the shell 11 to mount the plurality of panel buttons on the exterior of shell 11. The shell 11 is made of a rigid material, such as polycarbonate, and is typically manufactured by injection molding.

Figure 5:
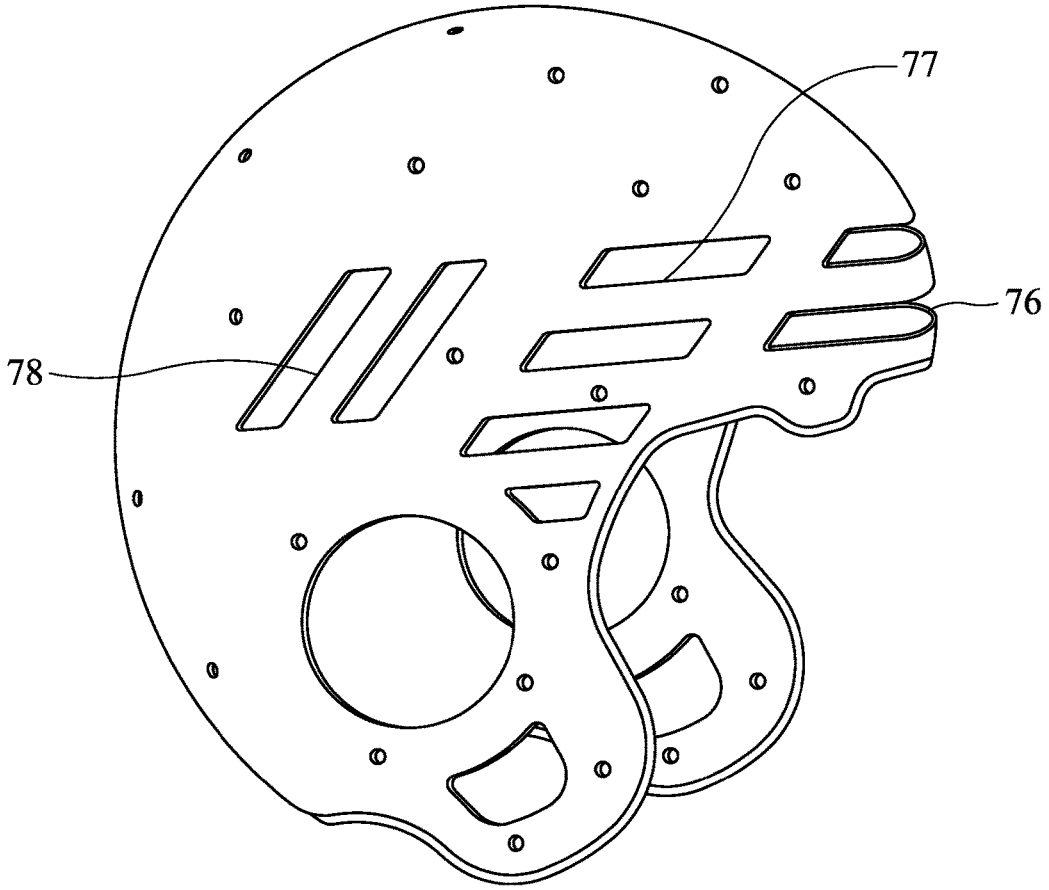

An alternate version of the shell 11 that may be used to practice this invention is depicted in FIG. 5. The shell 11 in this embodiment contains additional openings; such as openings 76, 77, and 78; to provide additional ventilation in the helmet.

Another embodiment of the invention is shown in FIG. 6. In this embodiment of the invention the lateral edges of the panel buttons are generally aligned with directly adjacent panel buttons. The gap between each panel button, for example the gap at 80 in FIG. 6, is preferably 3⁄16 of an inch or less.

Figure 7:
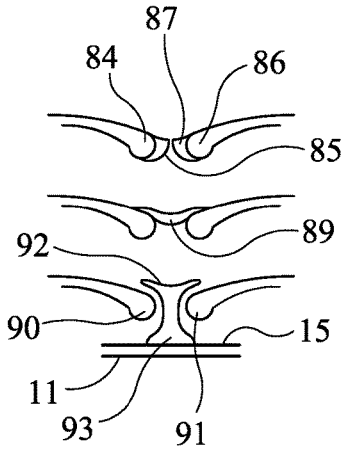
FIG. 7 is a cross-sectional view of adjacent lateral edges of panel buttons according to three alternative embodiments of the invention. The lateral edges are shown aligned with a directly adjacent panel button.

But a gap 80 is not necessary to practice the invention. It is also contemplated that the gap between adjacent panel buttons is filled, or generally absent, to give the helmet a smooth appearance. This may be accomplished by eliminating the gap altogether. Or alternatively, could be accomplished by filling the gap between directly adjacent panel buttons with other material. Referring to FIG. 7, a first lateral edge 84 of one panel button could be extended with rubber foam 85 to mate with a second lateral edge 86 of a second panel button that is likewise extended with rubber foam 87. Rubber foam extension 85 and 87 thusly fill the gap between adjacent panel buttons by being sufficiently large to touch.

In an alternative embodiment, the gap between two directly adjacent panel buttons is filled by covering that gap with a sealing strip 89 as also shown in FIG. 7. Sealing strip 89 could be held in place by friction, but alternatively could also be glued to one or both panel buttons.

In yet another alternative embodiment, the gap between two directly adjacent panel buttons is filled by placing a plastic or rubber insert between directly adjacent panel buttons. For example and again referring to FIG. 7, the gap between a first lateral edge 90 and a second lateral edge 91 could be filled with a rubber insert that has a general "I" shaped cross section. The top flange 92 of the insert serves to cover the gap between directly adjacent panel buttons. The bottom flange 93 of the insert serves to hold the insert in place and could be optionally mounted to the outer surface 15 of shell 11.

The protective helmet described in this invention is designed to create a misdirection of energy and shock absorption to reduce the acceleration of mass at impact. The misdirection disperses and dissipates energy by the interruption, transference, and absorption of the kinetic energy. The bumper effect slows down the mass before impact.

The exterior surface of the helmet does not have a traditional one piece shell. As depicted in the figures it is divided into individually shaped panels, arranged in a pattern or design. Each panel varies in size from very small up to approximately 5 inches in width. The panels are arranged equally spaced.

The shell to which the panels are attached is preferably made of one piece. It should be of sufficient size to include interior padding for the comfort and protection of the wearer. Generally slightly smaller than a standard helmet, it can be full coverage, or egg shell design, skeletal, webbed, or ventilated.

Each outer panel or panel button has an exterior composed of lightweight resilient polycarbonate or plastic type of material. These panels are fused to the button structure, which are made of plastic or strong foam rubber material. And as described previously, are secured to a one-piece inner shell. Typically, the inner shell and outer protective coating or shell are made of the same material. Each panel button is then attached to the shell with a centered fastener.

The shape of the panel buttons' exterior is preferably convex or domed. The effect of the shape creates a misdirected flow of energy at impact. The panel button flexes laterally as well as inwardly, which breaks up the straight line energy before it reaches the encompassing inner shell, and then the wearer's head and neck. This creates a reduction in acceleration, before the potentially damaging impact, which reduces force. When significant force is applied to a panel button, it flexes laterally and impacts the adjacent panel button(s), which transfers and disperses kinetic energy originated by initial impact. If the impact is substantial, then multiple panel buttons will flex, impact, transfer, and disperse.

The edges of the panel buttons are wrapped and bonded with a durably covered foam material that resists tearing. The multi-function or application of the wrap is to create the illusion of a one-piece outer shell while absorbing and dissipating energy during the lateral interruption and transfer of kinetic energy. This is accomplished with the shape and design of the panel buttons.

Considering the forgiving and deflective nature of the domed panel buttons, there will be 2-3 or more opportunities to misdirect impact energy away from the head and neck. This system self regulates to greatly reduce trauma and G-force delivered to the head and neck area. Immediately after impact the panel buttons return to original shape and position, ready for the next impact.

While this invention has been illustrated and described in detail in the drawings and description, this is to be considered as illustrative and not restrictive in character. It should be understood that only the presently preferred embodiments have been shown and described and that all changes and modifications that come within the spirit of the invention are protected.

What is claimed is:

1. A helmet, comprising:

a shell with an outer surface, a plurality of panel buttons, the panel buttons having a proximal side, a distal face, and a lateral edge;

the proximal side of each of the panel buttons pivotally secured to the outer surface of said shell, the proximal side of each of the panel buttons consisting of a single pivot connection that is the sole connection to said shell to allow each of the pivot buttons to pivot in multiple directions, wherein the lateral edges of adjacent panel buttons are positioned in close proximity to contact one another through pivotal motion during impact to disperse energy from the impact across the panel buttons; and the panel buttons comprised of flexible material.

2. The helmet of claim 1, wherein the lateral edge of at least one of said panel buttons are aligned with the lateral edge of at least one directly adjacent panel button.

3. The helmet of claim 1, wherein the distal face of the panel buttons is convex shaped.

4. The helmet of claim 1, wherein the distal face of the panel buttons includes facets.

5. The helmet of claim 1, wherein the distal face of the panel buttons includes a rigid covering.

6. The helmet of claim 1, wherein the distal face of the panel buttons has a cone shape.

7. The helmet of claim 1, wherein the distal face of the panel buttons has a dome shape.

8. The helmet of claim 1, wherein at least one of the panel buttons is hexagonal shaped.

9. The helmet of claim 1, wherein directly adjacent panel buttons are 3/16 of one inch or less apart.

10. The helmet of claim 1, wherein at least one of said panel buttons is pivotally secured to the outer surface of said shell with a ball and socket joint.

11. The helmet of claim 1, wherein at least one of said panel buttons is pivotally secured to the outer surface of said shell with a living hinge.

12. The helmet of claim 1, wherein at least one of said panel buttons is pivotally secured to the outer surface of said shell with a rivet.

13. The helmet of claim 1, wherein at least one of said panel buttons is pivotally secured to the outer surface of said shell with a screw.

14. The helmet of claim 1, wherein at least one of said panel buttons includes an internal spring.

15. The helmet of claim 1, wherein at least one of said panel buttons is pivotally secured to the outer surface of said shell with a female-male mechanical snap connection.

16. The helmet of claim 1, wherein the lateral edge of said panel buttons includes a foam edge.

17. A helmet, comprising:

a shell with an outer surface with a convexly curved shaped;

a first panel button having a first proximal side with a first pivotal connection to the outer surface of the shell, wherein the first proximal side becomes narrower towards the shell to facilitate pivotal motion of the first panel button, wherein the first proximal side narrows towards the first pivotal connection that forms a sole connection between the first panel button and the shell, and a first distal face with a first convex shape that is more convexly curved as compared to the outer surface of the shell, wherein the first distal face has a first rigid covering, and a first lateral edge; and a second panel button having a second proximal side with a second pivotal connection to the outer surface of the shell, wherein the second proximal side becomes narrower towards the shell to facilitate pivotal motion of the first panel button, wherein the second proximal side narrows towards the second pivotal connection that forms a sole connection between the second panel button and the shell, a second distal face with a second convex shape that is more convexly curved as compared to the outer surface of the shell, wherein the second distal face has a second rigid covering, and a second lateral edge facing the first lateral edge of the first panel button, wherein the first lateral edge is positioned to contact the second lateral edge when the first panel button pivots during an impact to dissipate energy from the impact.

18. The helmet of claim 17, wherein the first distal face of the first panel button includes a rigid covering.

19. The helmet of claim 17, wherein the first panel button is hexagonal shaped.

20. The helmet of claim 17, wherein the first lateral edge of the first panel button includes a foam edge.

21. A helmet, comprising:

a shell with an outer surface;

a plurality of panel buttons, the panel buttons each having a proximal side, a distal face, and a plurality of lateral edges;

wherein the proximal side of each of the panel buttons is pivotally secured to the outer surface of the shell;

wherein the panel buttons are arranged in an array that covers the entire outer surface of the shell; and wherein the lateral edges of the panel buttons and the lateral edges of the panel buttons that are directly adjacent thereto are all aligned with one another to give the helmet a smooth appearance.

22. The helmet of claim 21, wherein the distal face of each of the panel buttons includes a rigid covering.

23. The helmet of claim 21, wherein each of the panel buttons is hexagonal shaped.

24. The helmet of claim 21, wherein the distal face of each of the panel buttons has a dome shape.

25. The helmet of claim 21, wherein the lateral edge of each of the panel buttons includes a foam edge.

26. The helmet of claim 21, wherein the lateral edges of adjacent panel buttons are positioned in close proximity to contact one another through pivotal motion during impact to disperse energy from the impact across the panel buttons.

* * * * *